United States Patent [19]

Graf

[11] 4,351,993

[45] Sep. 28, 1982

[54] GAS-BLAST SWITCH

[75] Inventor: Rudolf Graf, Obermuhen, Switzerland

[73] Assignee: Sprecher & Schuh AG, Aarau, Switzerland

[21] Appl. No.: 183,429

[22] Filed: Sep. 2, 1980

[30] Foreign Application Priority Data

Nov. 16, 1979 [CH] Switzerland ..... 10246/79

[51] Int. Cl.[3] ..... H01H 33/88

[52] U.S. Cl. ..... 200/148 A; 200/148 F

[58] Field of Search ..... 200/148 A, 148 F

[56] References Cited

U.S. PATENT DOCUMENTS 4,329,553 5/1982 Graf ..... 200/148 A

FOREIGN PATENT DOCUMENTS 682313 3/1964 Canada ..... 200/148 A
1023118 1/1958 Fed. Rep. of Germany ... 200/148 F
1055642 4/1959 Fed. Rep. of Germany ... 200/148 F
1966973 9/1975 Fed. Rep. of Germany ... 200/148 F
796427 1/1936 France ..... 202/148 A

*Primary Examiner*—Robert S. Macon
*Attorney, Agent, or Firm*—Werner W. Kleeman

[57] ABSTRACT

A movable contact element is coupled by a step-up lever drive with a drive rod. The movable contact element is surrounded by a blast nozzle which moves along with the movable contact element. The blast nozzle is connected to a pump cylinder containing an extinguishing gas. The pump cylinder is guided to be vertically displaceable upon a pump piston and this pump piston is hingedly connected with one end of a first element of a toggle lever which in the cut-on position is in its bent position or mode, the second element of the toggle lever being hingedly connected at a stationary location. The toggle joint of the toggle lever is likewise coupled with the drive rod, so that during a cut-off stroke the toggle lever is extended and then again bent. So that at the start of a cut-off stroke there is initially accelerated the movable contact element and along therewith the blast nozzle as well as the pump cylinder and only thereafter is there compressed the extinguishing gas within the pump cylinder, the lever drive possesses a first coupling element or link which is hingedly connected at one end at the toggle joint and at its other end at the movable contact element as well as a second coupling element or link which is hingedly connected at one end between the ends of the first coupling element at such first coupling element and at its other end at the drive rod, so that at the start of the cut-off stroke the bent position of the toggle lever initially is intensified.

3 Claims, 3 Drawing Figures

GAS-BLAST SWITCH

BACKGROUND OF THE INVENTION

The present invention relates to a new and improved construction of a gas-blast switch.

Generally speaking, the gas-blast switch of this development is of the type comprising a movable contact element which is coupled by means of a step-up lever drive with a drive rod, and a blast nozzle which is co-movable with the movable contact element and surrounds the latter. The blast nozzle is connected with a pump cylinder containing an extinguishing gas, this pump cylinder being displaceably guided upon a pump piston. The pump piston is hingedly connected with one end of a first element of a toggle lever which in the cut-on position is in its bent position. A second element of the toggle lever is hingedly connected with a stationary location or point and the toggle joint of the toggle lever likewise is coupled with the drive rod, so that during a cut-off stroke the toggle lever is extended and then again bent.

Such type gas-blast switch is known, for instance, from German Pat. No. 1,966,973. With this switch the drive rod extends transversely with respect to the displacement direction of the assembly composed of the movable contact element, the blast nozzle and the pump cylinder. This assembly or unit is coupled by means of a rocker arm with the longer arm of an angle lever which is pivotably mounted at a stationary pin, the shorter arm of such angle lever being coupled by means of a coupling element or link at the drive rod. The toggle lever, at which there is coupled the pump piston, in the cut-on position is in a bent position directed away from the drive rod, and its toggle joint is connected by means of a further coupling element with such drive rod.

The construction of the heretofore known gas-blast switch operates such that between the movement of the drive rod and that of the movable contact element (together with the blast nozzle and pump cylinder) there is present a practically constant transmission which is governed by the length difference of the arms of the angle lever. On the other hand, the drive rod, immediately at the start of the cut-off stroke, pulls the toggle lever into its extended position, i.e. the pump piston moves immediately at the start of the cut-off stroke opposite to the cylinder, and only after there has been exceeded its extended position does it begin to move in the same direction as the pump cylinder.

Immediately at the start of a cut-off stroke the drive which drives the drive rod simultaneously must perform the following work. First of all, the movable contact element and the parts which co-move along therewith, such as the blast nozzle and cylinder, must be accelerated out of their stationary state. Secondly, during the opposite movement of the pump piston in relation to the cylinder there must immediately at the start be compressed the gas which is present in the cylinder, so that a short time later compressed extinguishing gas is available for blowing the switching arc.

However, it is strived that just at the start of the cut-off stroke the acceleration of the movable parts should have as high a value as possible, whereas the compression of the extinguishing gas should not start immediately at the beginning of the cut-off stroke, since the compressed extinguishing gas only must be available during a later point in time of the cut-off stroke, namely then when the increasing spacing of the movable contact element with respect to the stationary contact element, with which it was in engagement, approaches the minimum extinguishing distance.

SUMMARY OF THE INVENTION

Therefore, with the foregoing in mind it is a primary object of the present invention to provide a new and improved construction of a gas-blast switch of the previously mentioned type wherein in a most simple manner it is possible to apply the energy which must be exerted by the drive during a cut-off stroke, initially for the acceleration of the movable parts and only thereafter for the compression of the extinguishing gas, in other words to apply such energy in a staggered fashion, which, in turn, enables designing the entire drive so as to have smaller dimensions.

Now in order to implement this object and others which will become more readily apparent as the description proceeds, the proposed gas-blast switch of the present development is manifested by the features that the lever drive contains a first coupling element which is hingedly connected at one end at the toggle joint and at its other end at the movable contact element, and further contains a second coupling element which is hingedly connected at one end between the ends of the first coupling element with such coupling element and at its other end at the drive rod, so that at the start of the cut-off stroke the bent position of the toggle lever is initially further intensified.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
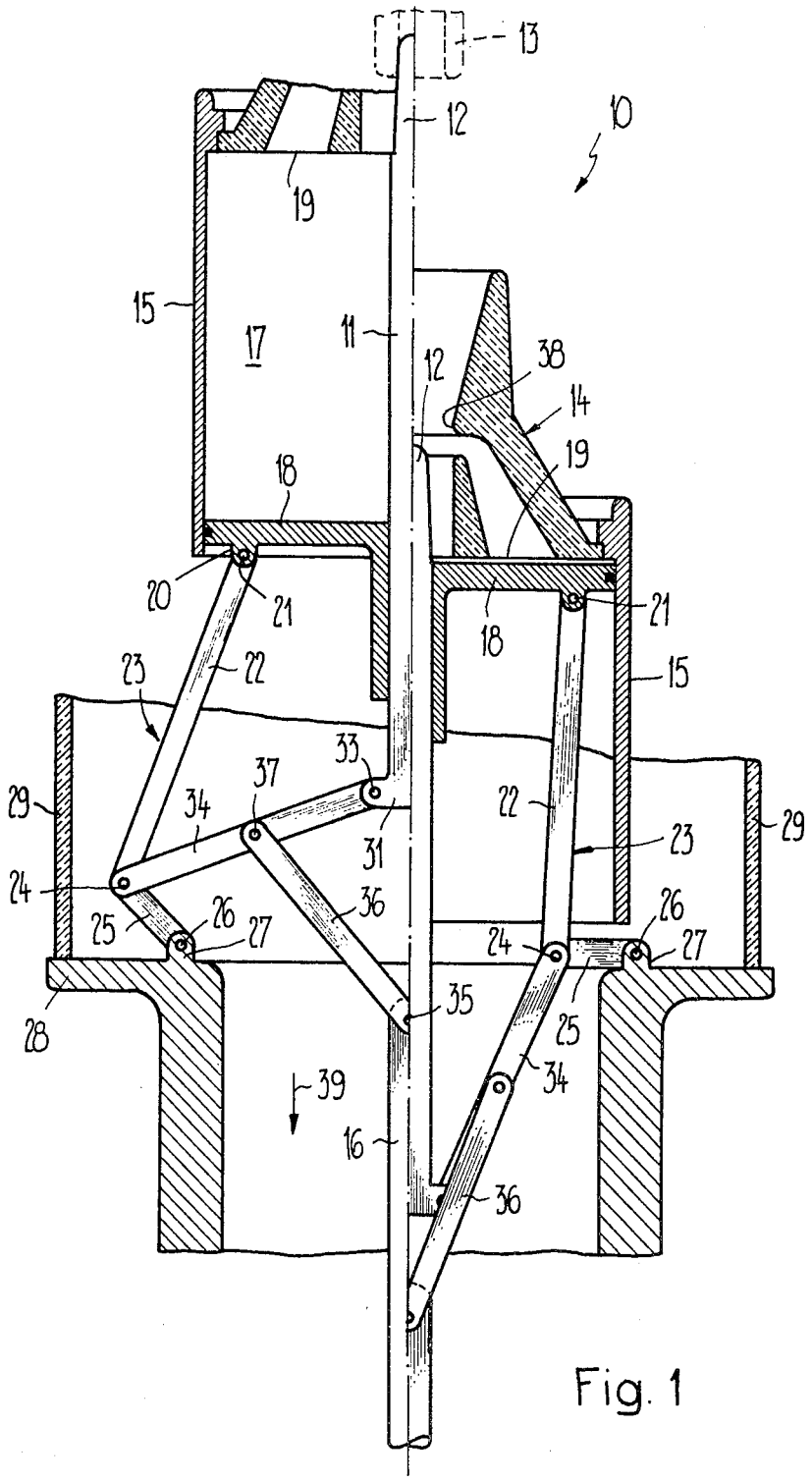
FIG. 1 is a schematic axial sectional view through a gas-blast switch of the invention, while omitting components thereof which are not important for understanding the underlying principles of this invention, there being shown at the left-hand side of the drawing the gas-blast switch in its cut-on position and at the right-hand side of the drawing (turned over through 180°) such gas-blast switch in its cut-off position.

Describing now the drawings, the exemplary embodiment of gas-blast switch 10, shown by way of example in FIG. 1, will be seen to possess a movable contact rod or element 11 which carries at its upper end a contact pin 12 which can be selectively brought into and out of engagement with a stationary contact element 13. At the contact rod 11 there is also attached by any suitable means a blast nozzle 14 which surrounds the contact pin 12, this blast nozzle 14 simultaneously forming the "floor" of a pump cylinder 15. This pump cylinder 15 encloses a pump chamber or compartment 17 which contains an extinguishing gas, typically for instance $SF_6$. Displaceably guided along the contact rod 11 is a pump piston 18 which is arranged within a pump cylinder 15. As will be demonstrated more fully hereinafter, the pump piston 18, during the course of a cut-off stroke, expels the extinguishing gas out of the pump chamber 17 through the blast nozzle 14. The inlet 19 of the blast nozzle 14 therefore directly flow communicates with the pump chamber or compartment 17.

At the side of the pump piston 18 which faces away from the pump chamber or compartment 17 there is formed a bearing eyelet 20 at which there is hingedly connected by means of a pivot pin 21 the free end of a first element or link 22 of a toggle lever, generally designated by reference character 23. The toggle joint or hinge of this toggle lever 23 is defined by a hinge pin 24, at which there is hingedly connected the second element or link 25 of the toggle lever 23. The free end of the second element 25 is hingedly connected by means of a hinge pin 26 at a bearing eyelet 27 which is attached or formed at one flange portion 28 of the gas-blast switch 10 and therefore immobile. The flange portion 28 furthermore carries a tubular-shaped insulator 29, which has only been partially shown, which surrounds a switching chamber in which there are arranged so as to be encapsulated with respect to the surroundings all of the heretofore described switch components or parts. Extending through the flange portion 28 is a drive rod 16 which can be axially displaced by means of any suitable and therefore not particularly illustrated drive as is well known in this art.

At the lower end of the contact rod 11 there is attached or formed a bearing eyelet 31, at which there is hingedly connected by means of a hinge pin 33 the one end of a coupling element or link 34, whose other end is hingedly connected at the hinge pin 24 of the toggle lever 23. At the upper end of the drive rod 16 there is hingedly connected, by means of a further hinge pin 35, the one end of a further coupling element or link 36, the other end of which is hingedly connected by means of a hinge pin 37 approximately centrally at the coupling element or link 34.

In the cut-on position illustrated at the left-hand portion of the showing of FIG. 1, the contact pin 12 is in engagement with the tubular-shaped fixed contact element 13 which encloses the contact pin 12, and additionally, retains the blast nozzle 14 closed at its narrowest location or throat 38.

Figure 2:
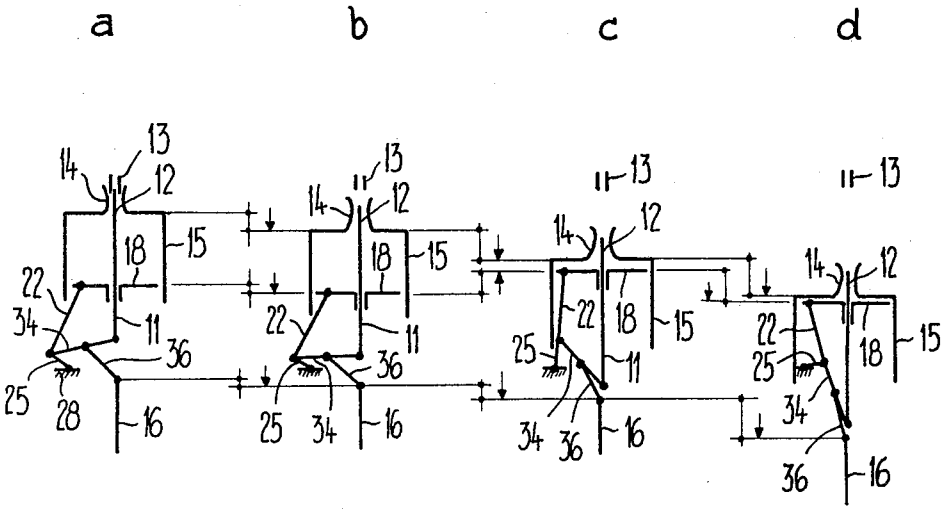
FIG. 2 illustrates in schematic view and in reduced axial sectional views the gas-blast switch of FIG. 1 in four different phases of the cut-off stroke designated by reference characters a, b, c and d.

As to the mode of operation of the described gas-blast switch reference is additionally made to the showing of FIG. 2, where there has been schematically shown while using the same reference characters the cut-on position in phase a as appears at the left-hand side of FIG. 1. During the cut-off stroke the drive rod 16 is moved in the direction of the arrow 39. At the beginning of the cut-off stroke the coupling element 36 downwardly draws the coupling element or link 34. Since the toggle lever-pivot pin 24 remains approximately at the same height, initially the contact rod 11 moves approximately twice as rapidly as the drive rod 16. However, the coupling element 34 simultaneously assumes the horizontal position, i.e. presses the toggle lever 23 in a still more accentuated bent position, so that initially the piston 18 moves in the same direction or sense, even if not through the same path, as the contact rod 11, thus, in the same direction of movement as the pump cylinder 15. Hence, at the starting phase of the cut-off stroke there occurs primarily an acceleration of the contact rod 11 and the components which move along with such contact rod 11. The end of this first phase a is then reached when the coupling element 34 protrudes at right angles from the contact rod 11, and the toggle lever 23 therefore has obtained its maximum bent position. The end of this first phase of the cut-off stroke has been illustrated in FIG. 2.

During the further course of the downward stroke of the drive rod 16 its movement is initially still transmitted with a stepped-up translation to the contact rod 11, and the coupling element 34 increasingly positions itself at an inclination, and thus, inwardly draws the toggle pin or joint 24, so that the toggle lever 23 again extends. However, now there occurs an opposite movement of the piston 18 in relation to the cylinder 15, so that now there is predominantly accomplished a compression of the extinguishing gas within the pump chamber or compartment 17. The end of this so-called "compression phase" is reached when the toggle lever 23 is completely extended and has been illustrated in FIG. 2*c*.

During the further downward movement of the drive rod 16 the toggle lever 23 is pressed beyond its extended position, by the action of the coupling elements 34 and 36, and then progressively returns back into its bent position. Since now also the toggle joint 24 moves in the same sense as the drive rod 16, the transmission of its movement to the contact rod 11 occurs practically without any step-up translation, whereas the pump piston 18 again moves in the same sense as the cylinder 15. The end of this phase has been reached with the cut-off position and has been illustrated in FIG. 2*d*.

Figure 3:
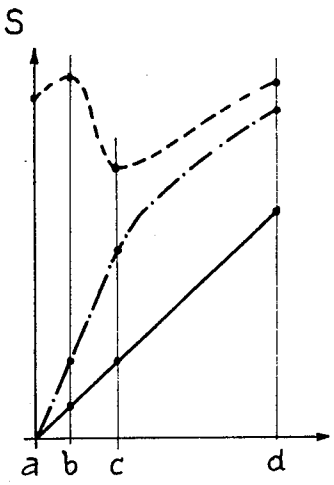
FIG. 3 schematically illustrates a displacement path-time graph for explaining the operation of the gas-blast switch.

In FIG. 3 there has been shown a simplified pathtime graph, wherein for the sake of simplicity it is to be assumed that from the beginning (a) up to the end (d) of the cut-off stroke the drive rod 16 moves linearly as a function of time. The movement of the drive rod 16 has therefore been illustrated in FIG. 3 with the full or solid line. The movement of the contact rod 11 and along therewith the contact pin 12 has been illustrated in FIG. 3 with the chain-dot curve. It will be recognized that the contact rod 11 moves appreciably more rapidly than the drive rod 16 up to the phase (point in time c) illustrated in FIG. 2*c*. After this time c the contact rod 11 increasingly moves at the same rapidity as the speed of movement of the drive rod 16.

With the broken line curve of FIG. 3 (containing a displaced origin or null point), the course of movement of the piston 18 has been illustrated. There will be seen that in the starting phase of the cut-off stroke, in other words between the points in time a and b the piston 18 moves in the same direction or sense, even though less rapidly, than the drive rod 16 and especially more rapidly than the contact rod 11, whereas between the points in time b and c the piston 18 moves in the opposite sense with respect to the contact rod 11. Thus while in the starting phase of the cut-off stroke the contact rod 11 is essentially accelerated, the compression of the extinguishing gas predominantly first occurs between the points in time b and c. Thereafter, the piston 18 again moves in the same sense and approximately with the same speed or rapidity as the speed of movement of the contact rod 11 and the drive rod 16. Between the FIGS. 2*a*, 2*b*, 2*c* and 2*d* there have been indicated in each case by the arrows the direction and the path through which move the drive rod 16, the contact rod 11 and the piston 18 during a cut-off stroke.

While there are shown and described present preferred embodiments of the invention, it is to be distinctly understood that the invention is not limited thereto, but may be otherwise variously embodied and practiced within the scope of the following claims. Accordingly,

What I claim is:

1. A gas-blast switch comprising:

a movable contact element;

a drive rod;

a step-up lever drive for operatively coupling said movable contact element with said drive rod;

a blast nozzle surrounding said contact element and movable along with said movable contact element;

a pump cylinder containing an extinguishing gas;

said blast nozzle being connected with said pump cylinder;

a pump piston upon which there is displaceably guided said pump cylinder;

a toggle lever having a first element and a second element;

said pump piston being hingedly connected with one end of said first element of said toggle lever which in a cut-on position of the gas-blast switch is located in a bent position of the toggle lever;

means defining a stationary location with which there is hingedly connected said second element;

said toggle lever containing a toggle joint operatively coupled with said drive rod, so that during a cut-off stroke of the gas-blast switch the toggle lever is extended and then again bent;

said lever drive comprising a first coupling element and a second coupling element;

said first coupling element being connected at one end with said toggle joint and at its other end with said movable contact element; and said second coupling element being connected at one end between the opposed ends of said first coupling element at said first coupling element and at its other end being hingedly connected with said drive rod, so that at the start of the cut-off stroke the bent position of the toggle lever initially is intensified.

2. The gas-blast switch as defined in claim 1, wherein:

said second coupling element is hingedly connected between the center and a hinge point of the first coupling element at the movable contact element of the first coupling element.

3. The gas-blast switch as defined in claim 1, wherein:

said first coupling element possesses approximately the same length as said second coupling element; and said second element of said toggle lever being shorter than said first coupling element.

* * * * *